US005393959A

United States Patent [19]

Kitano et al.

[11] Patent Number: 5,393,959

[45] Date of Patent: Feb. 28, 1995

[54] INDUCTION HEATING ROLLER APPARATUS

[75] Inventors: Yoshio Kitano; Kozo Okamoto, both of Kyoto, Japan

[73] Assignee: Tokuden Co., Ltd., Kyoto, Japan

[21] Appl. No.: 178,049

[22] Filed: Jan. 6, 1994

[51] Int. Cl.[6] ..... H05B 6/14

[52] U.S. Cl. ..... 219/619; 219/647; 219/469; 29/895.1; 29/895.23; 100/93 RP; 492/16; 492/46

[58] Field of Search ..... 219/619, 647, 652, 469, 219/470, 471; 29/895.1, 895.2, 895.211, 895.212, 895.213, 895.22, 895.23; 100/93 RP, 93 R, 92; 492/7, 16, 46

[56] References Cited

U.S. PATENT DOCUMENTS 4,533,808 8/1985 Newman ..... 219/619
4,535,230 8/1985 Brieu ..... 219/470
4,679,287 7/1987 Allard ..... 100/93 RP
5,151,576 9/1992 Zaoralek ..... 219/469
5,254,070 10/1993 Callhoff ..... 219/619

*Primary Examiner*—Philip H. Leung
*Attorney, Agent, or Firm*—Morgan & Finnegan

[57] ABSTRACT

An induction heating winding structure 5 is installed inside a hollow roller 1, which is closed at its opposite ends by flanges 2A, 2B. Driving shafts 4A, 4B integral with the flanges having coaxial holes are rotatably supported. The induction heating winding structure 5 is supported at its opposite side by support rods 9A, 9B. The support rods are in the coaxial holes 10A, 10B of the driving shafts through bearings. The roller 1 and flanges 2A, 2B are fastened together through taper fit. When it is desired to release the roller 1 from the flanges, the driving shafts and the support rods are temporarily fastened and one driving shaft 4B is supported in a cantilever manner. The roller 1 is mounted on a transport mechanism for mounting and dismounting.

3 Claims, 11 Drawing Sheets

INDUCTION HEATING ROLLER APPARATUS

TECHNICAL FIELD

The present invention relates to an induction heating roller apparatus.

BACKGROUND ART

An induction heating roller apparatus includes a hollow roller made of a metal having suitable degrees of permeability and conductivity (or electrical resistance), e.g., carbon steel, and an induction heating winding structure forming a primary coil, the structure being supported for relative rotation within the hollow roller. In turn, the roller is supported for rotation preferably by a separate bearing structure. The winding structure is in the form of a coil wound on a bobbin-like iron core coaxially within the roller, with its lead wires being led outside the roller through the shaft of the coil (sleeve rod) extending through the roller shaft. The leads are then connected to an AC power source of commercial frequency.

In the induction heating roller device described above, turning the power switch on causes an exciting current to flow through the coil, with the resulting magnetic flux circulating through a magnetic circuit where the flux pass through the coil via the bobbin-like iron core made of a core material, such as silicon steel sheets, reaching the roller side, radially moving and then turning back to pass through the cylindrical portion of the roller, reaching the opposite roller side; thus, an eddy current based on alternating magnetic flux flows through the roller body, particularly the cylindrical portion, generating Joule heat (eddy current loss).

Such induction heating roller is used to effectively transmit pressure and heat to a material to be processed in printing, embossing of sheets, calendering of paper, and the like operation.

FIG. 10 shows the common construction of such induction heating roller apparatus, comprising a roller 1 and flanges 2A and 2B fixed to the opposite ends of the roller 1 by bolts 3A and 3B to close the opposite ends. The characters 4A and 4B denote driving shafts integral with the flanges 2A and 2B, having through-holes 3A and 3B, respectively. The shafts being rotatably mounted on the machine frame by bearings, not shown.

The numeral 5 denotes an induction heating winding structure comprising a bobbin-like iron core 6 and an induction coil 7 wound thereon. The numeral 8 denotes lead wires connected to the induction coil 7 and led outside and connected to an AC power source. The characters 9A and 9B denote sleeve-like rods axially projecting from the opposite ends of the winding structure 5 to support the latter and extending through the through-holes 30A and 30B of the driving shafts 4A and 4B. Bearings and 10B are interposed between the support rods 9A, 9B and the through-holes 30A, 30B. A stop ring 11 for the bearing 10A is installed in the wall surface of the through-hole 30A, and stop rings 12 and 13 for the bearing 10B are installed in the wall surface of the through-hole 30B. Further, the lead wires 8 are inserted in the through-hole of one support rod 9B and allowed to be led outside. Thus, the support rods 9A and 9B and hence the induction heating winding structure can be stationary, while the driving shafts 4A and 4B of the roller are rotatable.

In this connection, it is to be mentioned that this type of an apparatus is sometimes used for imparting patterns to sheets, such as paper, non-woven fabrics, or iron sheets. To this end, the outer surface of the roller is embossed with a required pattern, but when it is desired to impart a different pattern to sheets, another roller having such different pattern has to be used. To this end, the roller 1 alone has to be separated for exchange from the winding structure.

Conventionally, for such exchange, the roller 1 built in the apparatus is mounted as such on a suitable stand. Then the bolt 3A for the driving shaft 4A on the left hand is removed to release the flange 2A from the connection with the roller 1, and the stop ring 11 is removed. Then the flange 2A and the driving shaft 4A are moved leftwardly of the roller 1 and thereby separated from the roller 1.

The bolt 3B for the driving shaft 4B on the right hand is removed to release the flange 2B from the connection with the roller 1, and the inner stop ring 12 is removed. Then the flange 2B and the driving shaft 4B are moved rightwardly of the roller 1 and thereby separated from the roller 1. Thereafter, the induction heating winding structure 5 is withdrawn together with the support rods 9A and 9B from the roller 1. The resulting state is shown in FIG. 11.

As a result of this operation, the roller 1 is separated from the other components and exchanged for another roller 1 and the components are assembled in the order reverse to that for disassembly.

However, since the flanges 2A and 2B are tightly fitted in the roller 1, the withdrawal of the individual flanges from the roller 1 is no easy operation according to the separating procedure described above. Further, when the bearings 10A and 10B are separated from the support rods 9A and 9B in separating the driving shafts 4A and 4B together with the bearings 10A and 10B from the support rods 9A and 9B, there is nothing left to support the support rods 9A and 9B, causing the latter to incline under gravity or fall down onto the inner surface of the roller 1; thus, care must be taken in performing this operation.

The assembling operation subsequent to the exchange of the roller 1 comprises the steps of inserting the induction heating winding structure 5 with the support rods 9A and 9B into the roller 1 and fitting the front ends of the rods 9A and 9B in the bearings 10A and 10B disposed inside the driving shafts 4A and 4B. However, the involved fitting operation is not easy and then, with this fitted state maintained, the flanges 2A and 2B have to be attached to the roller 1; thus, this operation is very troublesome.

That is, the mounting and dismounting operation of the roller and flanges of this type of apparatus are made troublesome by two factors; (1) the tight fit between the roller and the flanges, and (2) the separable construction of the three component sections: the roller, the driving shafts integral with the induction heating winding structure.

SUMMARY OF THE INVENTION

The present invention is intended, in an induction heating roller apparatus including a roller, driving shafts integral with flanges, and support rods integral with an induction heating winding structure, to facilitate the mounting and dismounting of the flanges for exchange of the roller.

The induction heating roller according to the basic arrangement of the present invention has means for fastening the roller and flanges by a taper fit and temporarily fastening the driving shafts and support rods.

An induction heating roller according to another arrangement of the invention has, in addition to the basic arrangement described above, support means for supporting one driving shaft, and transport means for carrying the roller unfastened from the flanges and transporting it to the other driving shaft.

In the roller apparatus of the present invention, since the roller and flanges are fastened by a taper fit, releasing them from this fastening makes it possible to separate the flanges from the roller by slightly moving the flanges. Further, in assembling operation, slightly moving the flanges and roller to each other results in tightly fitting them together.

In mounting and dismounting the roller and flanges, since the driving shaft of one of the flanges and the support rod associated with the one flange are integrally fastened together, the driving shaft integral with the flange and the support rod integral with the induction heating structure are further integrated together and hence can be relatively extracted from and inserted into the roller.

According to a preferred arrangement of the invention, the driving shafts and flanges, and the support rods and induction heating winding structure are integrally supported in a cantilever manner by a support mechanism. Therefore, the roller unfastened from the flanges can be easily transported to another station as it is placed on a carrier or transport mechanism.

DETAILED DESCRIPTION OF THE PREFERRED EMBODIMENTS

Figure 1:
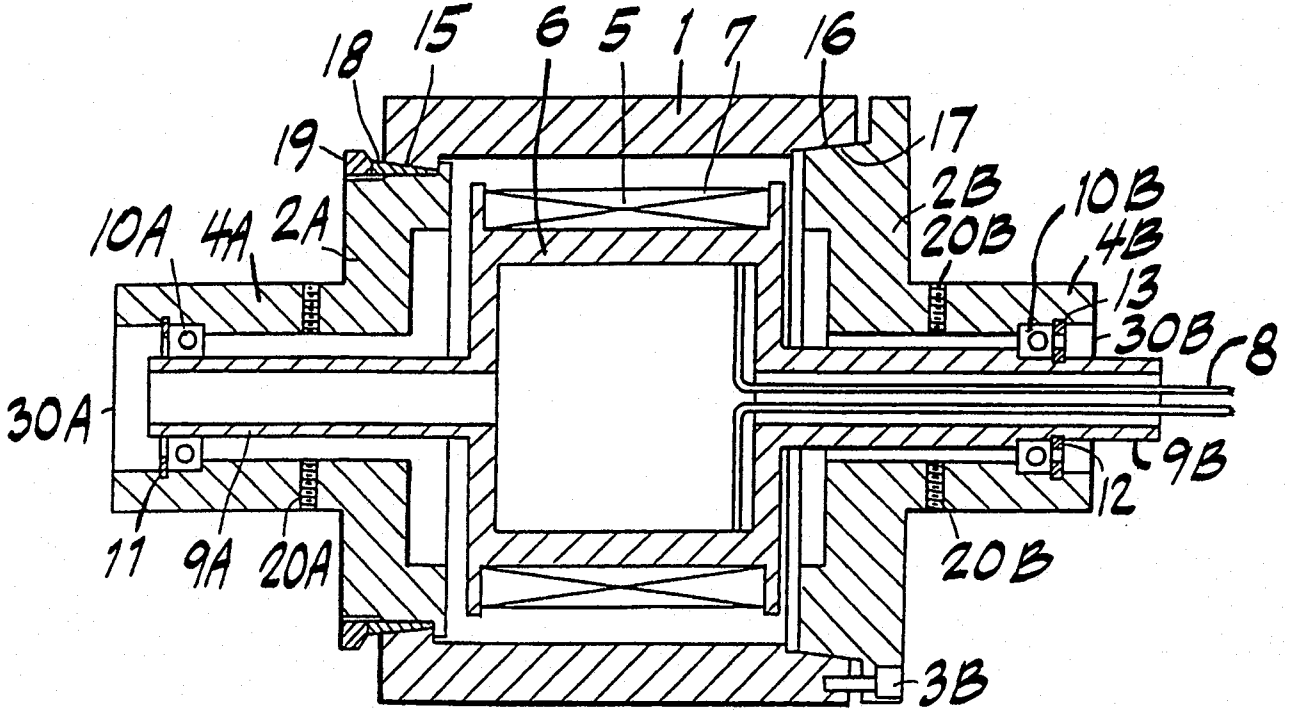
FIG. 1 is a sectional view showing the basic embodiment of the invention.
Figure 10:
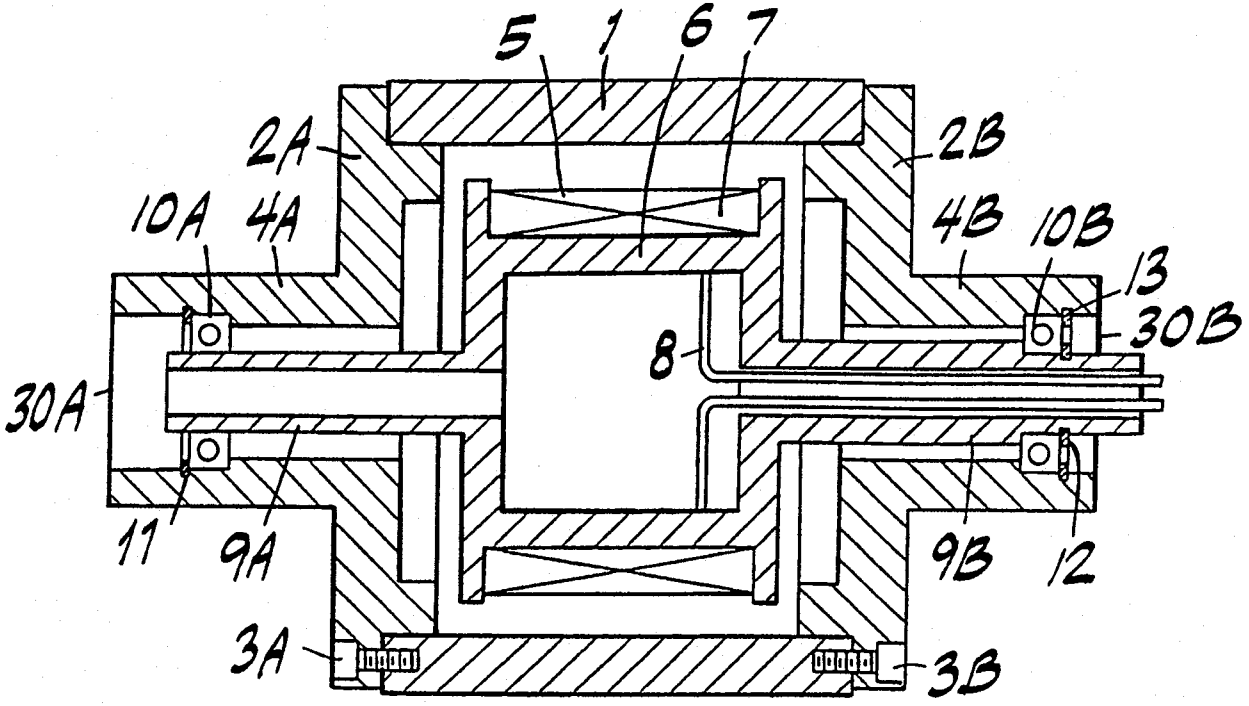
FIG. 10 (Prior Art)
FIG. 10 is a sectional view showing a conventional arrangement.
Figure 11:
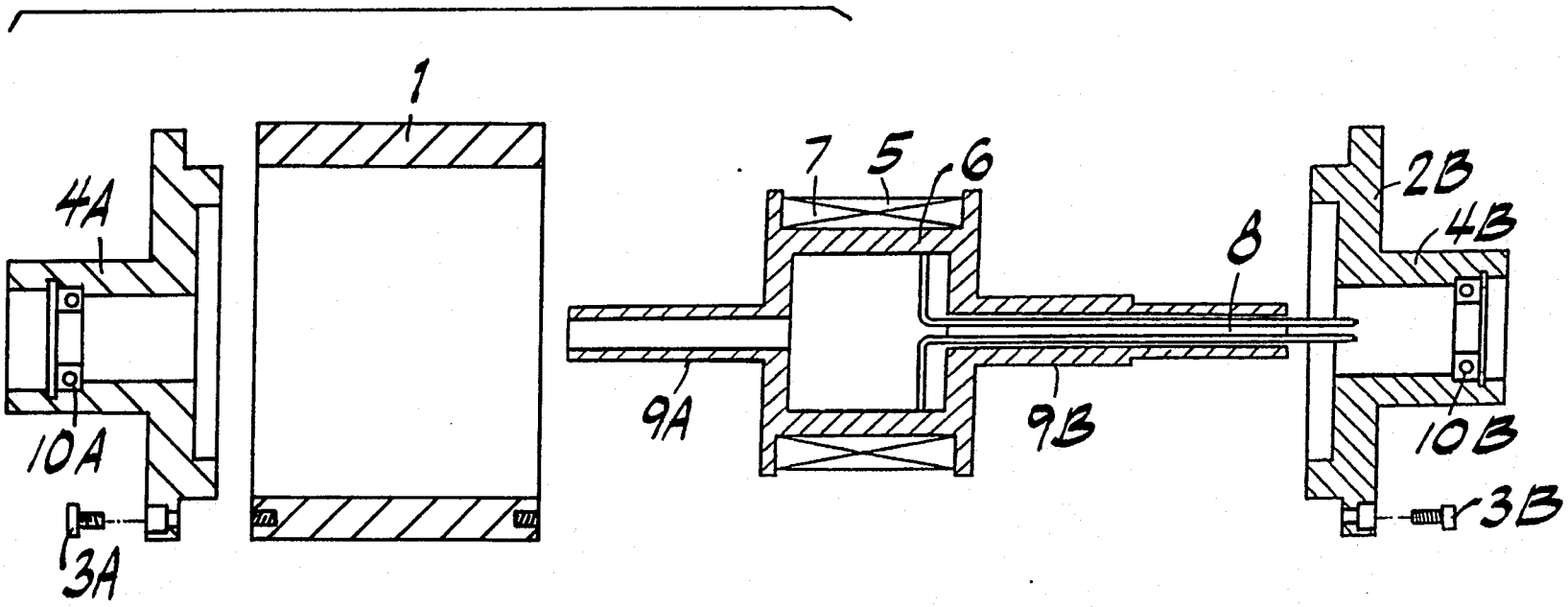
FIG. 11 (Prior Art)
FIG. 11 is an exploded sectional view of the conventional arrangement.

Embodiments of the present invention will now be described. In this case, the same parts as those shown in FIG. 10 indicate the same or corresponding parts. In one embodiment according to the invention, as shown in FIG. 1, a roller 1 made, e.g., of carbon steel and flanges 2A and 2B preferably made of the same material as that of the roller are fastened together by a taper fit. Stated specifically, the inner surface of the roller is formed at the opposite ends with taper surfaces 15 and 16 inclined to enlarge the opening outwardly. The peripheral surface of the flange 2B adapted to fit in one opening surface of the roller 1 to close the same is in the form of a taper surface complementary to the taper surface 16.

The peripheral surface of the flange 2A adapted to correspond with and close the other opening surface of the roller 1 is not formed with a slope, and instead a sleeve 18 of wedge-shaped cross section is interposed between said peripheral surface and the taper surface 15, thereby effecting intimate engagement therebetween. The sleeve 18 is slitted at a place on its periphery. In this invention, bolts 3A used in the prior art are not employed.

The outer end of the sleeve 18 is pushed by a nut 19 in the form of a ring adapted to be engaged with a rear threaded portion of the outer periphery of the flange 2A. This pushing results in tightly fastening the roller 1 and flanges 2A and 2B together. In this state, the roller 1 is rotated with the driving shafts 4A and 4B, performing the required operation.

Further, the present invention has also means for temporarily fastening the driving shafts 4A, 4B and the support rods 9A, 9B together when it is desired to unfasten the roller 1 and the flanges 2A and 2B from each other. Stated specifically, the peripheral surfaces of the driving shafts 4A and 4B are formed with threaded holes 20A and 20B radially extending and circumferentially equispaced.

When it is desired to unfasten the roller 1 and flanges 2A and 2B from each other, bolts 21A and 21B are forced into the threaded holes 21A and 21B until their front ends abut against the outer peripheral surfaces of the support rods 9A and 9B. Thereby, the flanges 2A, 2B, and driving shafts 4A, 4B, and, the support rods 9A, 9B and induction heating winding structure 5 are integrally fastened together by the bolts 21A and 21B.

Figure 2:
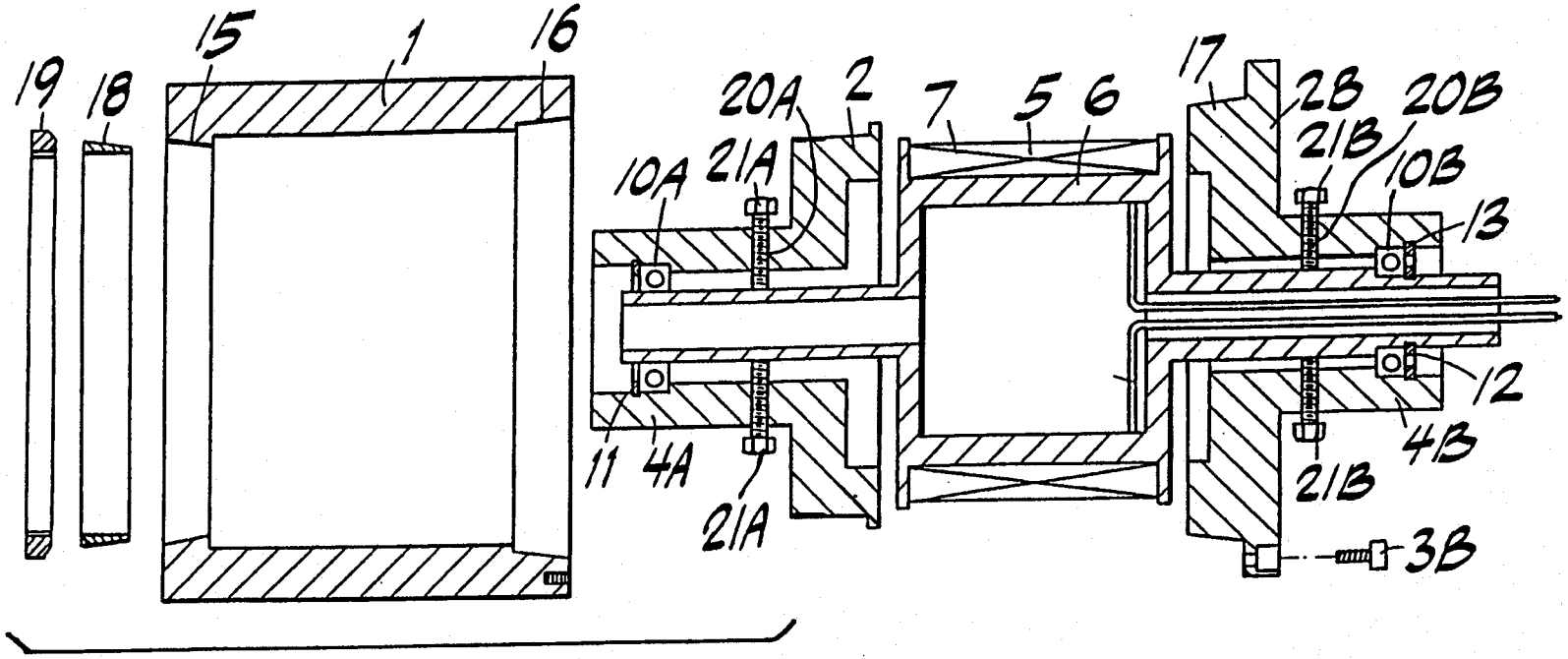
FIG. 2 is an exploded sectional view in the arrangement of the basic embodiment.

In this state, the sleeve stop nut 19 is loosened and removed, followed by removal of the sleeve 18 and bolt 3B, allowing the flanges 2A, 2B and driving shafts 4A, 4B, and the support rods 9A, 9B and induction heating winding structure 5 to be removed as an integral body from the roller 1. Such separated state is shown in FIG. 2. The operation subsequent to the exchange of the roller 1 is performed in the reverse sequence for assembly.

According to such arrangement, since the roller 1 and the flanges 2A and 2B are fastened by a taper fit, the necessary fitting pressure can be obtained by a slight contact pressure and the unfastening thereof is also easy.

For exchange of the roller, the mounting on and dismounting from the roller 1 of the flanges 2A, 2B and driving shafts 4A, 4B, and the support rods 9A, 9B and induction heating winding structure 5 are easy since they can be maintained as an integral body in their temporarily fastened state. Further, such integration fixes the relative position of their axis, the adjustment of the axis during disassembly and assembly is facilitated.

Figure 3:
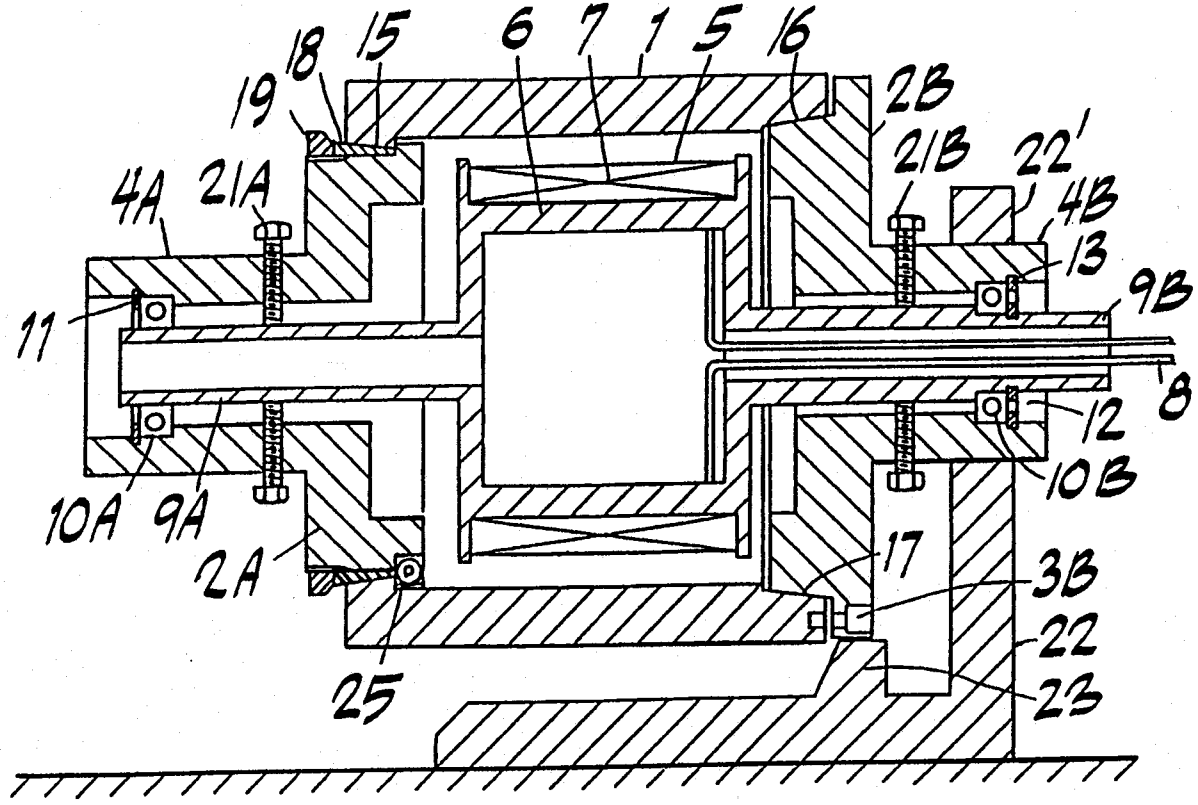
FIG. 3 is a sectional view showing a second embodiment of the invention.

According to a second embodiment of the invention, as shown in FIG. 3, a support mechanism for temporarily supporting the driving shaft 4B, particularly a support stand 22 having a shaft support recess is prepared in addition to the shaft-rod fixing thread construction. The heating roller apparatus is lifted by a crane from the position of use and conveyed to the support stand 22. And the driving shaft 4B is mounted on the support stand and is fixed in position by having placed thereon an upper stand portion 22' having a symmetrical recess. As a result, the entire apparatus is supported in a cantilever manner. In addition, an auxiliary stand 23 formed on the support stand 22 may be used to auxiliarily support the flange 2B. This state is shown in FIG. 3.

Figure 4:
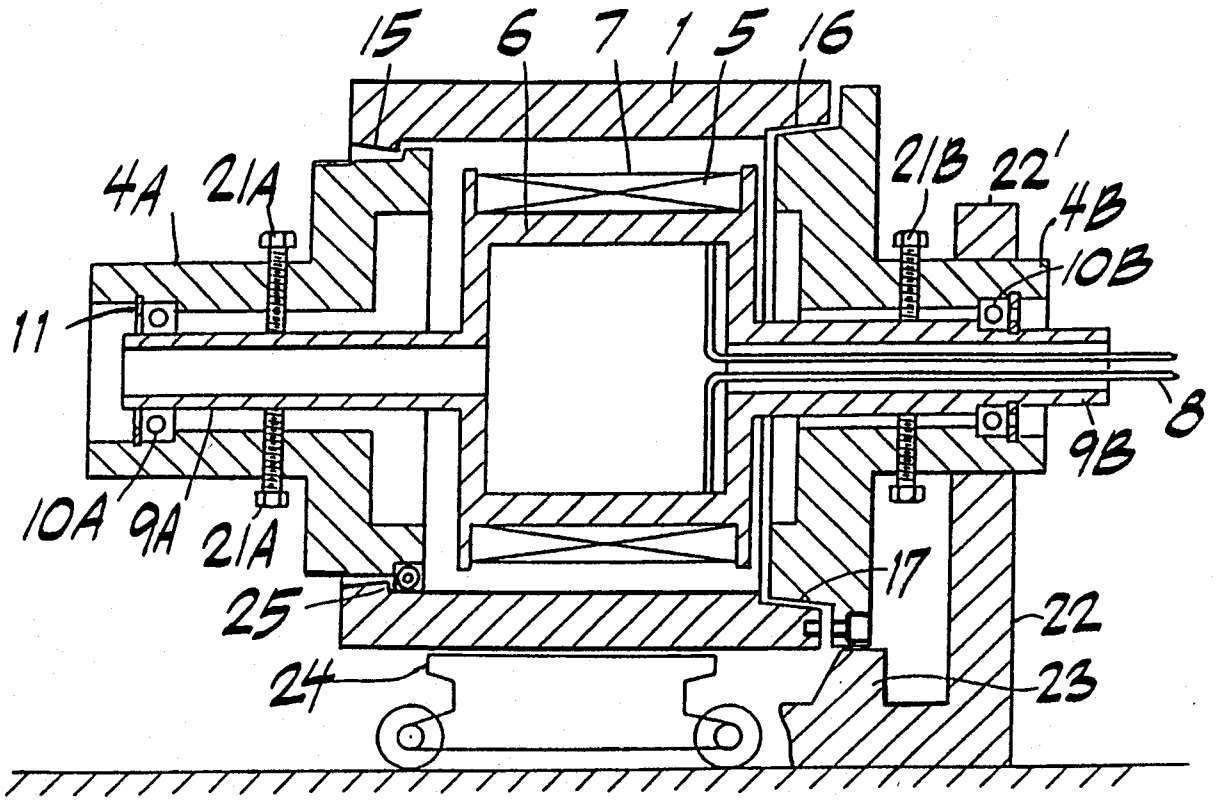
FIG. 4 is a sectional view showing a roller mounted on a transport mechanism in the second embodiment of FIG. 2.

In this state, a transport mechanism 24 whose level is adjustable is prepared and placed under the roller 1. And the nut 19 is unfastened to remove the sleeve 18 and the bolt 3B, whereupon the flanges 2A, 2B and driving shafts 4A, 4B, and the support rods 9A, 9B and induction heating winding structure 5 are structurally separated as an integral body from the roller 1. Further, the roller 1 is mounted on the transport mechanism 24. This separated state is shown in FIG. 4.

Figure 5:
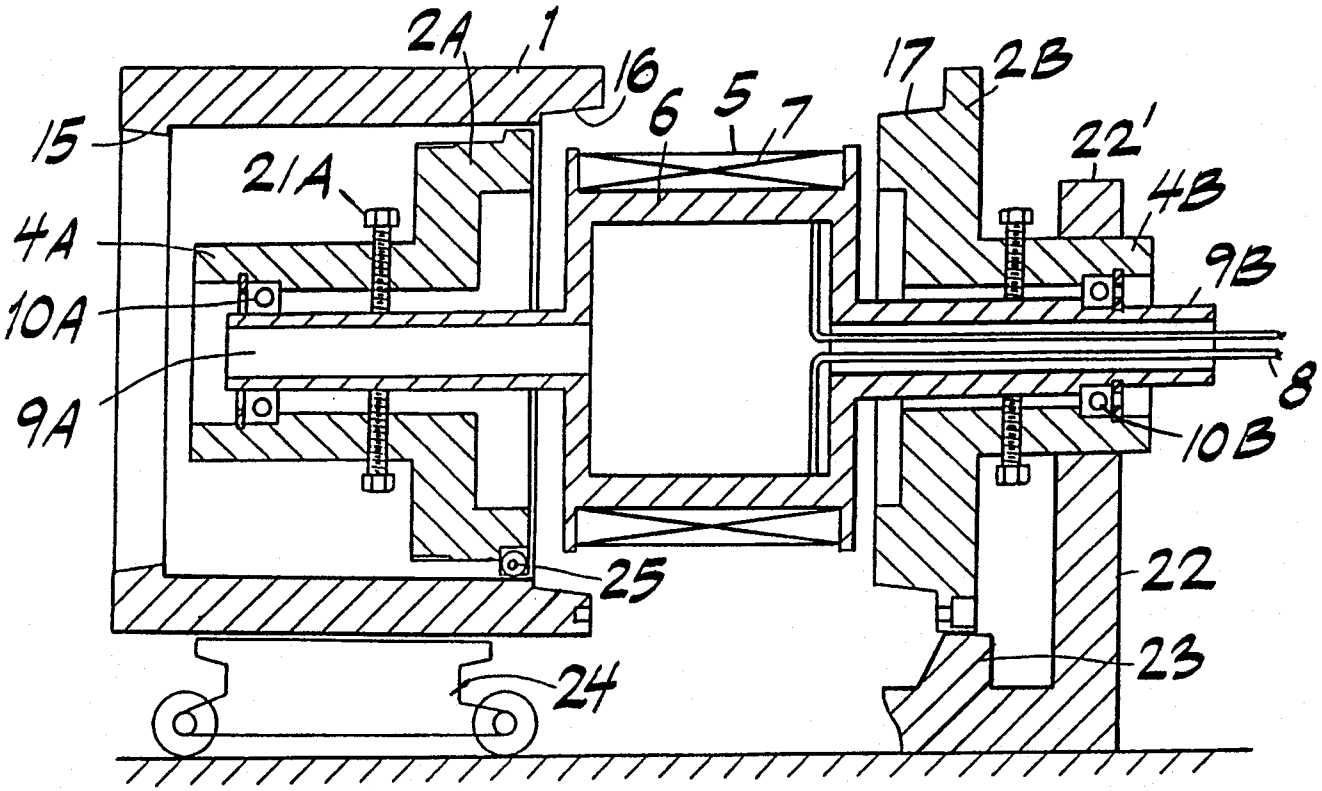
FIG. 5 is a sectional view showing the transport mechanism in the moved state in the second embodiment.

Thereafter, the transport mechanism 24 with the roller 1 mounted thereon is moved toward the driving shaft 4A. This state is shown in FIG. 5. In this case, if a plurality of small rollers 25 are installed around the lower peripheral region of the flange 2A, the transport of the roller 1 is facilitated as the rollers 25 roll along the inner peripheral surface of the roller 1 so that the lower peripheral region of the flange 2A no longer contacts with the roller 1 to interfere with the movement thereof.

Figure 6:
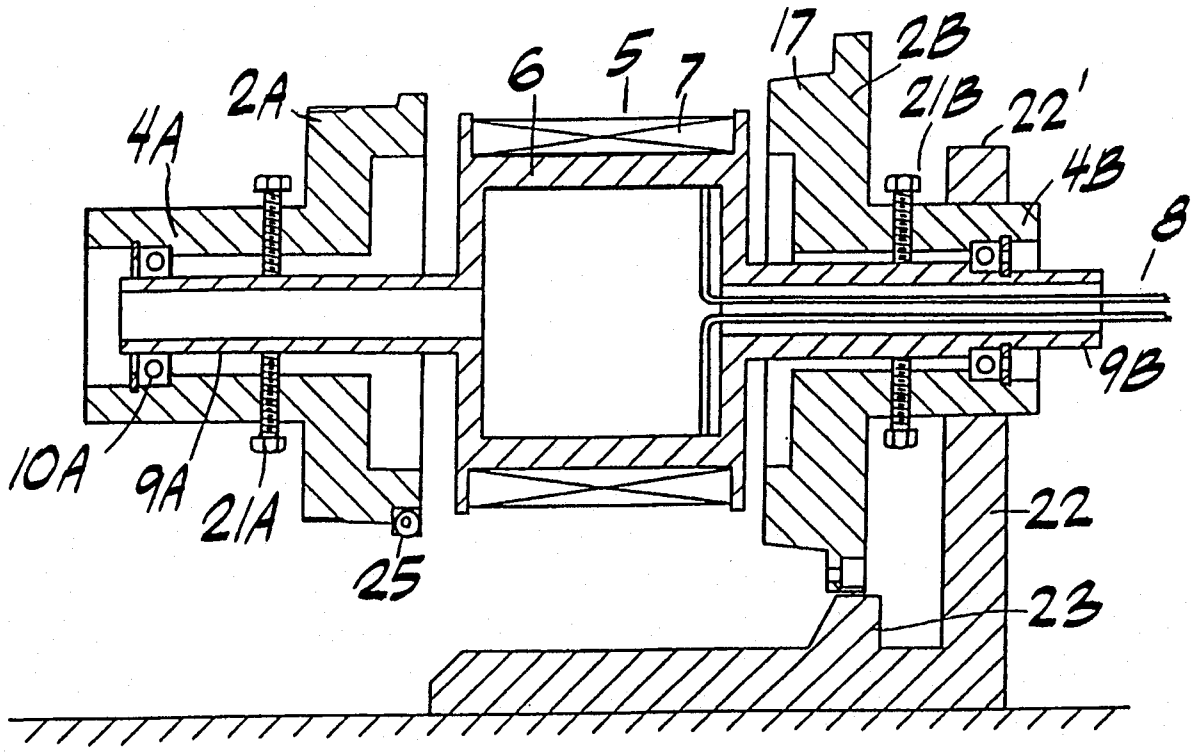
FIG. 6 is a sectional view with the roller removed.

The driving of the transport mechanism 24 is continued until the roller 1 is completely separated as shown in FIG. 6. When it is desired to attach a new roller, the separating operation described above is performed in the reverse order.

Figure 7:
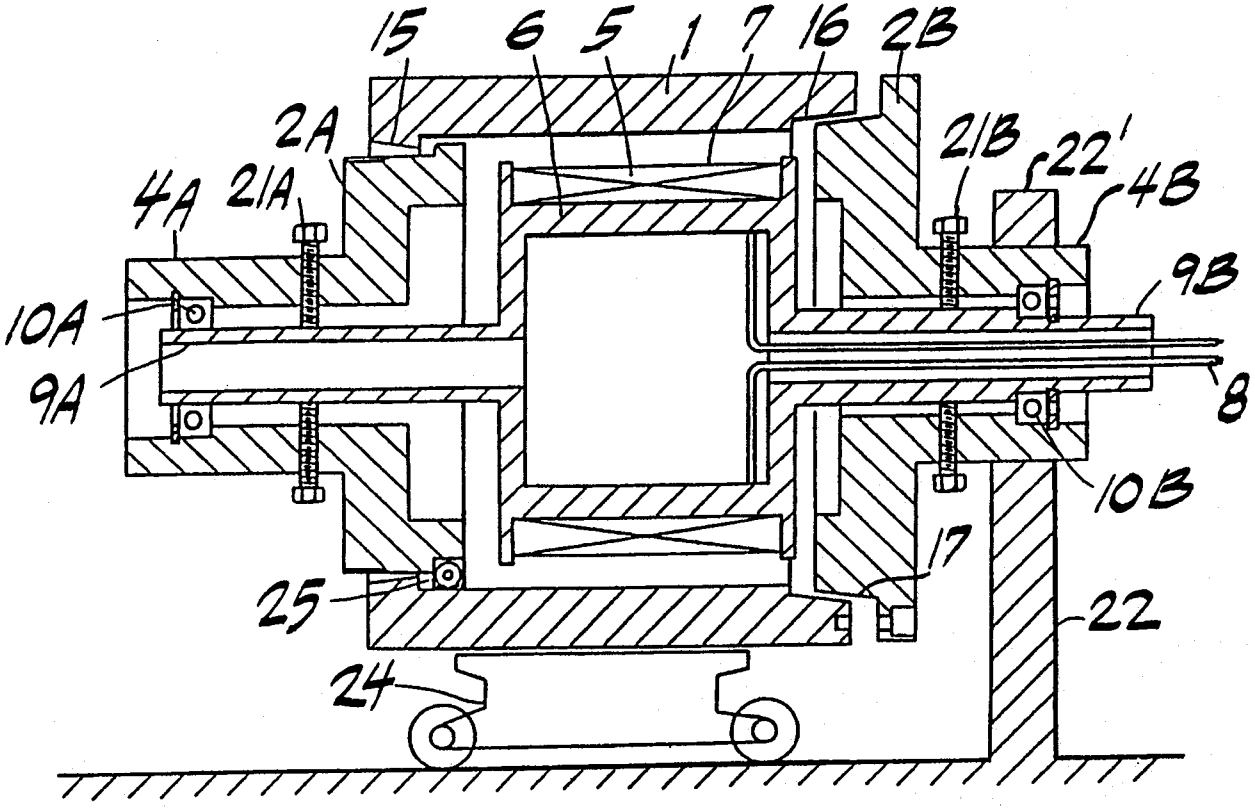
FIG. 7 is a sectional view showing another embodiment of the invention.
Figure 8:
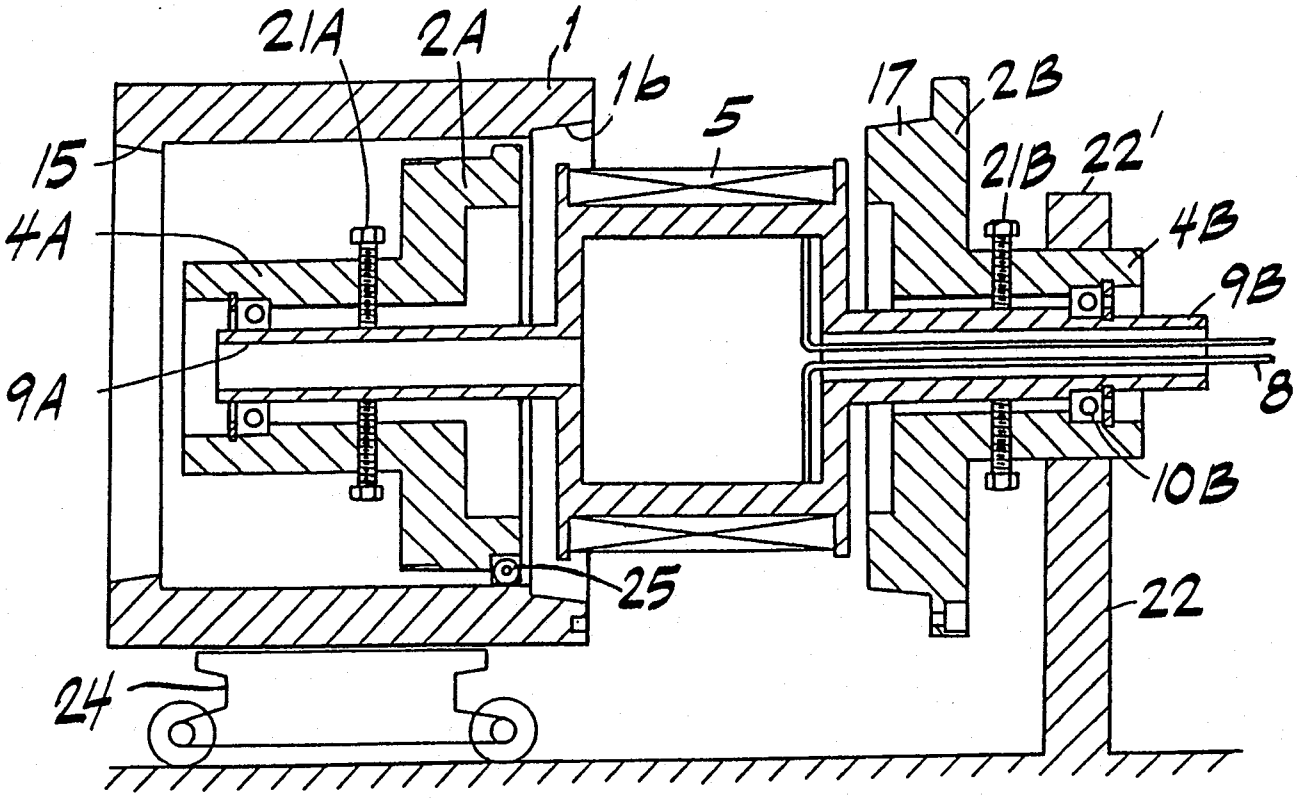
FIG. 8 is a sectional view showing the transport mechanism in the moved state.
Figure 9:
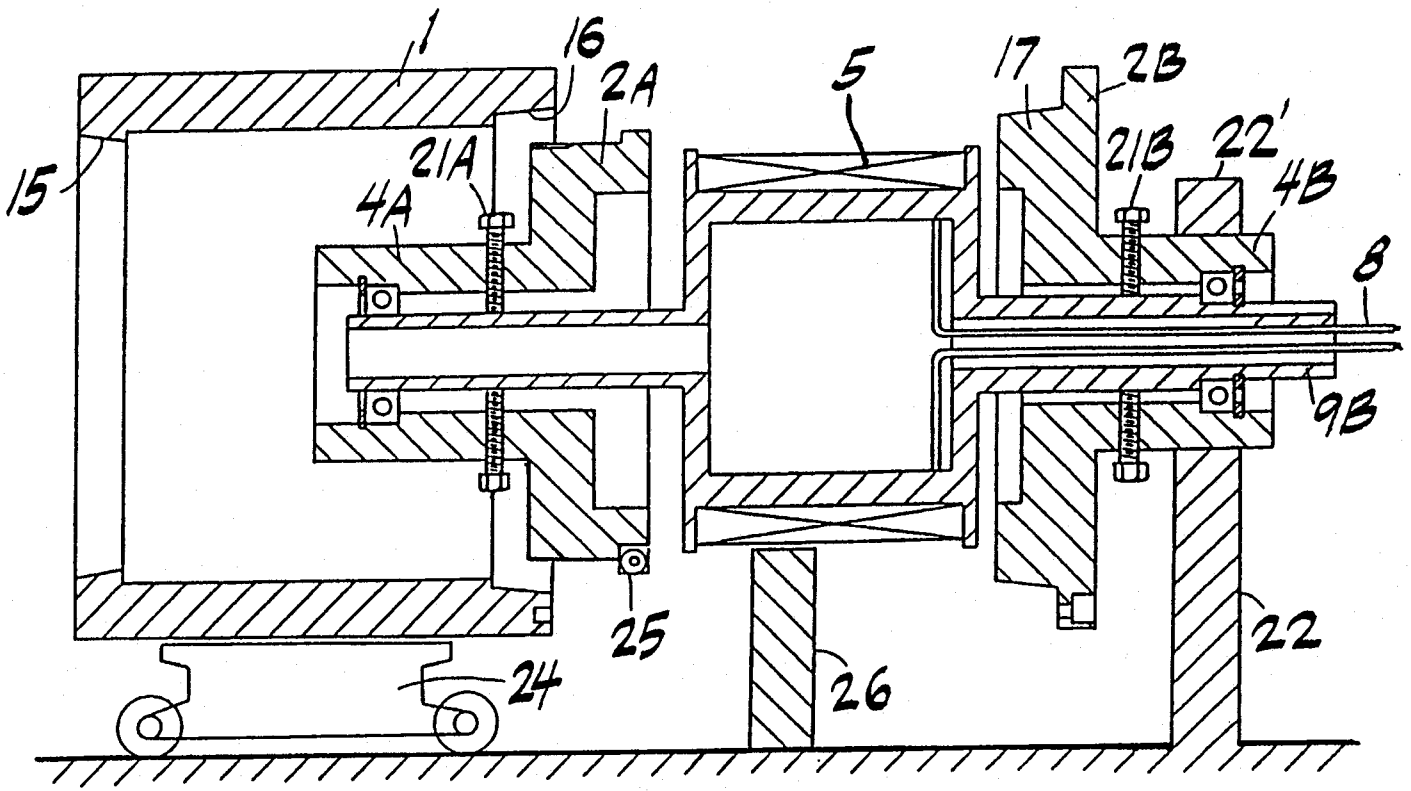
FIG. 9 is a sectional view with the roller moved.

Another embodiment of the invention is shown in FIGS. 7 through 9. This example does not use the auxiliary stand 23 for the flange 2B. As shown in FIG. 7, in the beginning, the transport mechanism 24 is placed under the roller 1. And the nut 19 is removed, followed by removal of the sleeve 18 and bolt 3B, whereupon, as in the case of FIG. 2, the flanges 2A, 2B, driving shafts 4A, 4B, support rods 9A, 9B and induction heating winding structure 5 are separated as an integral body from the roller 1. The roller 1 is mounted on the transport mechanism 24.

Then the transport mechanism 24 as such is moved toward the driving shaft 4A as shown in FIG. 8, and the induction heating winding structure 5 is supported from below by a separately prepared auxiliary stand 26 as shown in FIG. 9 before the roller 1 leaves the flange 2A. The components thus supported in a cantilever manner by the support mechanism 24 are stabilized in position. The transport mechanism 24 is further moved until the roller 1 is completely separated.

As described above, in mounting and dismounting the roller, one driving shaft mechanism is supported in a cantilever manner; thus, the mounting and dismounting and transport of the roller can be performed with highest safety.

What is claimed is:

1. An induction heating roller apparatus comprising:

a cylindrical roller in the form of a hollow cylindrical body of both-end open type having opposite end openings, further having magnetic permeability and electric conductivity, said openings having inner peripheral portions forming axially outwardly enlarged inner peripheral taper surfaces;

a pair of flanges having magnetic permeability and electric conductivity each including a flange body, a driving shaft projecting from said flange body along a central axis thereof in one axial direction and an axial through-hole extending through said flange body and said driving shaft, one of said flanges having a peripheral taper surface which can be fitted into one of said inner peripheral taper surfaces of said roller, with said driving shaft of said flange being positioned outside said cylindrical roller, and other one of said flanges having a peripheral surface which can be snugly held in said other inner peripheral taper surface of said roller through an annular wedgelike sleeve, with driving shaft of said flange being positioned outside said cylindrical roller;

screw means fastening one of said flanges to said roller at one end thereof;

nut means for threadedly engaging an edge portion of the peripheral surface of said other flange exposed from said annular wedgelike sleeve to force said sleeve toward one of said flanges resulting in press-fitting said sleeve between said peripheral surface of said other flange and said other inner peripheral taper surface of said roller;

an induction heating winding structure coaxially received with a surrounding clearance in a hollow space surrounded by said roller and said pair of flanges fitted to or held by said roller, said structure including a cylindrical bobbinlike iron core, a winding wound thereon and a pair of support rods extending from opposite ends of said iron core through said axial through-holes of said driving shafts for relative rotation, each of support rods having a longitudinal through-hole;

lead wires for said winding extending through at least one of said longitudinal through-holes to be led outside said space surrounded by said roller and said flanges; and fastening means for temporarily holding together said pair of support rods of said structure and said driving shafts of corresponding said flanges when said roller and said pair of flanges are released from each other, said fastening means including a threaded radial through-hole formed on each said driving shaft and a screw member therethrough to press against corresponding said rod.

2. An induction heating roller apparatus comprising:

a cylindrical roller in the form of a hollow cylindrical body of both-end open type having opposite end openings, further having magnetic permeability and electric conductivity, said openings having inner peripheral portions forming axially outwardly enlarged inner peripheral taper surfaces;

a pair of flanges having magnetic permeability and electric conductivity each including a flange body, a driving shaft projecting from said flange body along a central axis thereof in one axial direction and an axial through-hole extending through said flange body and said driving shaft, one of said flanges having a peripheral taper surface which can be fitted into one of said inner peripheral taper surfaces of said roller, with said driving shaft of said flange being positioned outside said cylindrical roller, and other one of said flanges having a peripheral surface which can be snugly held in said other inner peripheral taper surface of said roller through an annular wedgelike sleeve, with driving shaft of said flange being positioned outside said cylindrical roller;

screw means fastening one of said flanges to said roller at one end thereof;

nut means for threadedly engaging an edge portion of the peripheral surface of said other flange exposed from said annular wedgelike sleeve to force said sleeve toward one of said flanges resulting in press-fitting said sleeve between said peripheral surface of said other flange and said other inner peripheral taper surface of said roller;

an induction heating winding structure coaxially received with a surrounding clearance in a hollow space surrounded by said roller and said pair of flanges fitted to or held by said roller, said structure including a cylindrical bobbinlike iron core, a winding wound thereon and a pair of support rods extending from opposite ends of said iron core through said axial through-holes of said driving shafts for relative rotation, each of support rods having a longitudinal through-hole;

lead wires for said winding extending through at least one of said longitudinal through-holes to be led outside said space surrounded by said roller and said flanges; and support means for supporting at the said driving shaft of one of said flanges of said induction heating roller apparatus consisting of said roller, said pair of flanges one fitted into the other snugly held in said roller, and said induction heating winding structure coaxially received in said hollow space inside said roller, when said roller apparatus has been removed from a bearing structure for said driving shafts;

fastening means for temporarily holding together said pair of support rods of said structure and said driving shafts of corresponding said flanges when said roller and said pair of flanges are released from each other, said fastening means including a threaded radial through-hole formed on each said driving shaft and a screw member therethrough to press against corresponding said rod; and transport means for supporting said roller when released from said pair of flanges, with at least one of said driving shafts being supported by said support means, directing said roller to the other of said flanges and transporting it beyond said other flange.

3. A roller apparatus as set forth in claim 2, characterized in that said support means for supporting at least said driving shaft of one of said flanges is to also support the flange body of said one flange.

* * * * *